US005088616A

United States Patent [19]

Susko et al.

[11] Patent Number: 5,088,616

[45] Date of Patent: Feb. 18, 1992

[54] COVER FOR USE WITH A RECEPTACLE

[75] Inventors: Thomas J. Susko, East Detroit; James P. Constantino, Mt. Clements; Gerald A. Parylo, Detroit, all of Mich.

[73] Assignee: Cadillac Products, Inc., Troy, Mich.

[21] Appl. No.: 595,980

[22] Filed: Oct. 11, 1990

[51] Int. Cl.[5] ..... B65D 51/04

[52] U.S. Cl. ..... 220/343; 220/908; 220/909

[58] Field of Search ..... 220/334, 335, 342, 343, 220/908, 909; 224/273

[56] References Cited

U.S. PATENT DOCUMENTS

| | | | |
|---|---|---|---|
| Re. 30,890 | 3/1982 | Hodge . | |
| 3,202,310 | 8/1965 | Tibbets | 220/334 X |
| 3,687,328 | 8/1972 | Spruyt et al. . | |
| 3,828,969 | 8/1974 | Schurman . | |
| 3,902,628 | 9/1975 | Schurman . | |
| 3,989,162 | 11/1976 | Hodge et al. . | |
| 3,994,415 | 11/1976 | Hodge . | |
| 4,014,457 | 3/1977 | Hodge . | |
| 4,098,429 | 7/1978 | Hodge . | |
| 4,148,411 | 4/1979 | Hodge et al. . | |
| 4,151,928 | 5/1979 | Fagliano et al. . | |
| 4,152,979 | 5/1979 | Schmidt . | |
| 4,158,424 | 6/1979 | Carmack . | |
| 4,161,261 | 7/1979 | Frater . | |
| 4,186,844 | 2/1980 | Swanson . | |
| 4,199,075 | 4/1980 | Rohrer . | |
| 4,213,539 | 7/1980 | Reuter . | |
| 4,285,624 | 8/1981 | Propst et al. . | |
| 4,290,352 | 9/1981 | Schmidt et al. . | |
| 4,335,828 | 6/1982 | Robinson et al. . | |
| 4,342,402 | 8/1982 | Jungles . | |
| 4,401,312 | 8/1983 | Parker . | |
| 4,432,467 | 2/1984 | Swingley, Jr. | 220/334 |
| 4,445,623 | 5/1984 | Kolling et al. . | |
| 4,456,141 | 6/1984 | Pamment . | |
| 4,550,849 | 11/1985 | Adsit . | |
| 4,609,117 | 9/1986 | Pamment . | |
| 4,674,665 | 6/1987 | Van Kirk | 224/273 |
| 4,771,940 | 9/1988 | Taylor | 220/335 |
| 4,949,866 | 8/1990 | Sanders | 220/334 |
| 4,955,501 | 9/1990 | Hodge | 220/315 |
| 4,967,944 | 11/1990 | Waters | 224/273 |

*Primary Examiner*—Stephen Marcus
*Assistant Examiner*—Stephen Cronin
*Attorney, Agent, or Firm*—Harness, Dickey & Pierce

[57] ABSTRACT

A cover of generally rectangular shape having a deformation reinforced central section comprises thermoforming top and bottom sheets of thermoplastic to form a specially configured arrangement of strengthening ribs which extend in longitudinal and oblique directions and of a post and receptacle centrally of the sheets, and pressing the sheets together to form a closed interior. The longitudinal ribs on the bottom sheet intersect and are welded to the oblique ribs or the top sheet respective and the post is welded into the receptacle to reinforce the center of the cover. The sheet edges are welded together to reinforce the cover shape and form a reinforced hinge support.

19 Claims, 3 Drawing Sheets

COVER FOR USE WITH A RECEPTACLE

BACKGROUND AND SUMMARY OF THE INVENTION

This invention is directed to a lid for covering the top opening of a trash receptacle and more particularly to a thermoformed lid having a two piece vacuum formed construction and formed to include a specially configured arrangement for stiffening the center as well as the front, rear and side edges of the lid.

Steel lids have been used to cover trash receptacles but such lids are expensive to fabricate and have a disadvantage that they are relatively easily damaged in mechanical handling. They also have a disadvantage in that they are heavy and pose a hazard to the user loading trash into the receptacle. Another disadvantage is that such lids are difficult to repair should they become damaged. As a result of the difficulty of repair it is not unusual that these lids go unrepaired with a consequence that the receptacle is not effectively sealed when not in use.

Refuse containers are typically located out of doors where they are exposed to the weather. One problem is that steel lids are subject to rust. It is highly desirable to prevent rainwater which invariably collects on horizontal surfaces of such covers, from entering the containers first because of mere water volume weight and second because of problems added to the disposition of waste materials if they are soggy with or floating in polluted water.

Lightweight non-metallic receptacle covers are known and illustrated by U.S. Pat. Nos. 4,151,928 issuing May 1, 1979 to Fagliano et al., 4,158,424 issuing June 19, 1979 to Carmack, 4,445,623 issuing May 1, 1984 to Kolling et al. and 4,456,141 issuing June 26, 1984 to Pamment. While the cover shown in each of these patents may have been suitable for its intended use, a lightweight yet rigidly reinforced plastic cover would be desirable.

This invention provides an improved cover for use with a trash receptacle, the cover being integrally molded of plastic sheet material to include a hinge mounting arrangement adjacent to the rear edge of the cover, and stiffening ribs specially configured for reinforcing the central section as well as the front edge, the rear edge and the sides of the cover. The cover is constructed from two planar sheets of plastic, which sheets are first vacuum thermoformed to include stiffening ribs and then pressed together whereby to weld the sheet edges together and define a substantially sealed interior. The stiffening ribs from the lower sheet intersect with the ribs on the upper sheet whereby the ribs from one sheet are welded to the other sheet and, at least in part, welded to the ribs of the other sheet.

Additional rigidifying is provided by the unique arrangement of ribs. Peripheral portions of the edges from each of the two sheets are welded together, first to form a flange to maintain the shape of the cover, seal the cover periphery, and provide channel to drain water from the cover, and second to form a plurality of laterally spaced U-shaped hinge housings across the rear edge, the load bearing housings and flange thus being of double thickness. Further, lateral ribs extend upwardly from each of the sheets adjacent the front of the cover, the rib from the bottom sheet being interfitted into the rib of the upper sheet and welded thereto, the ends of the rib on the upper sheet being curled to assure a locked fitment with the rib on the lower sheet.

Further a post extends from the lower sheet for welded fitment within and to the walls of a receptacle formed by cross-ribs on the upper sheet, thus rigidifying the central portion of the cover.

Such a cover is lightweight yet durable, is capable of sustaining abuse during its use and provides an inexpensive cover for trash bins. The integral specially stiffened cover effectively seals the open top of a receptacle without the necessity of having complex flanges for securing the cover to the receptacle. Further, the sealed twin sheet construction and specially configured ribs cooperate to provide a reinforced cover which inhibits buckling if stood upon and inhibits twisting or torsional bending. When welded together, the sheets and ribs cooperate to form a box beam construction that obviates the need for separate, but additional, reinforcement members. Additionally, the lightweight cover will diminish potential harm to a user if the lid should inadvertently fall.

The foregoing and other objects will become more apparent when viewed in light of accompanying drawings and following detailed description wherein:

DETAILED DESCRIPTION OF THE PREFERRED EMBODIMENT

Figure 1:
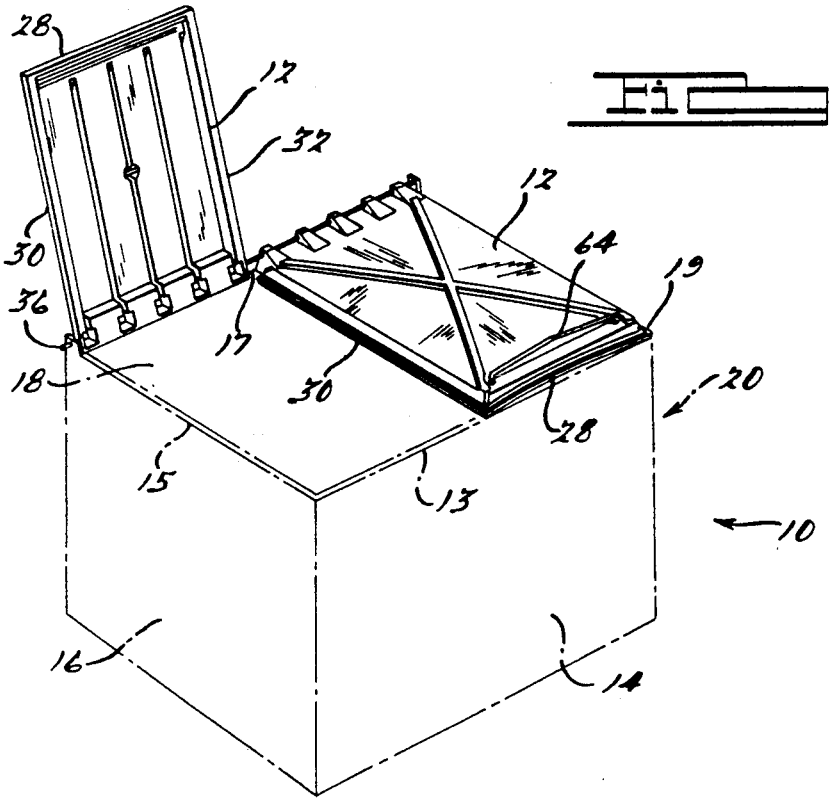
FIG. 1 shows a generally rectangular trash receptacle including a pair of covers according to the invention.
Figure 2:
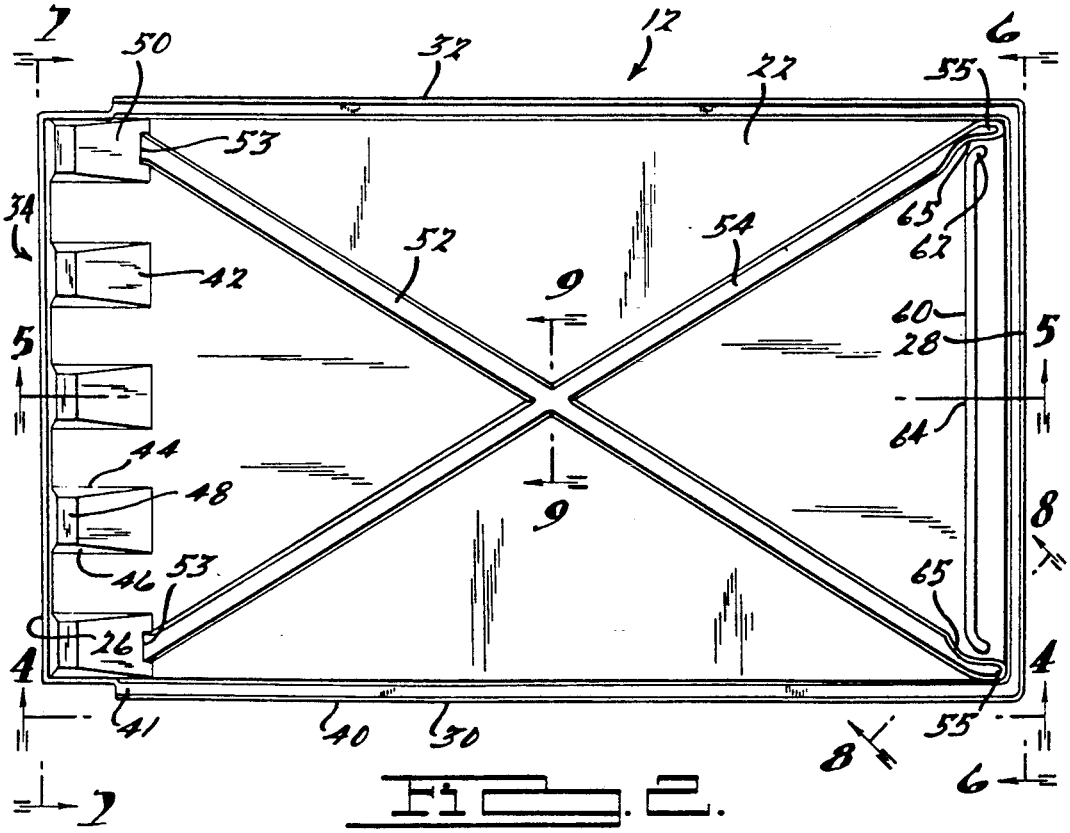
FIG. 2 is a plan view of one of the covers shown in FIG. 1.
Figure 3:
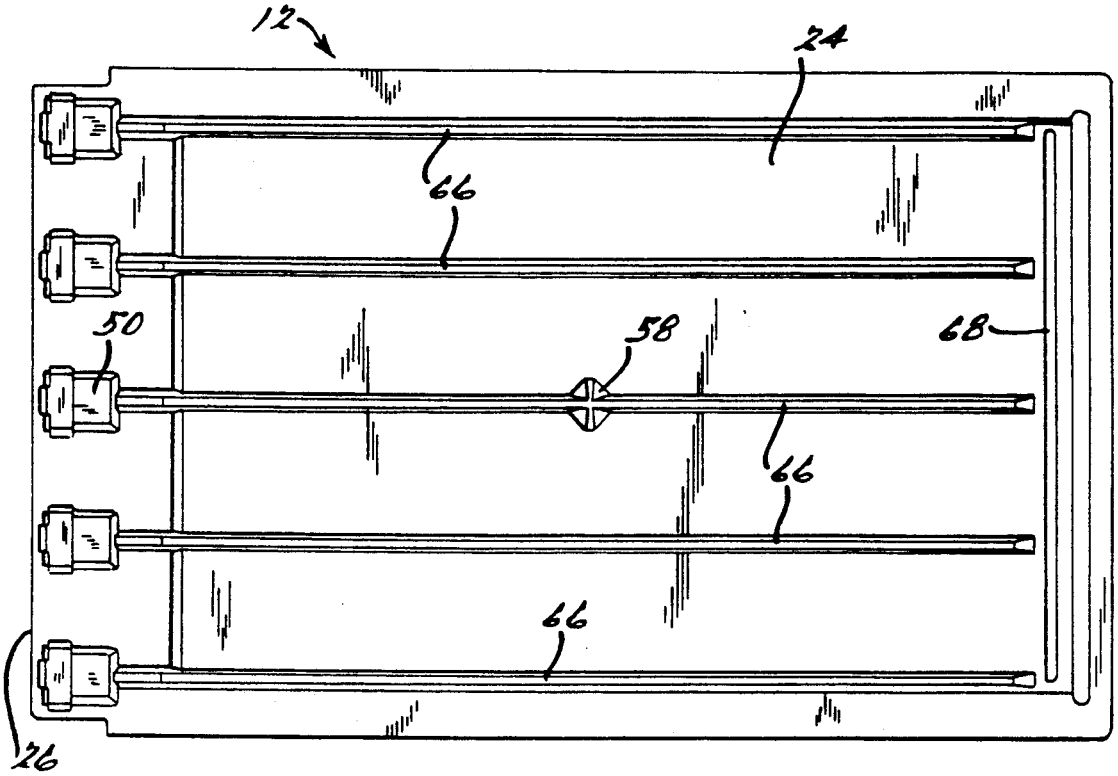
FIG. 3 shows the bottom of the cover shown in the invention.
Figure 6:
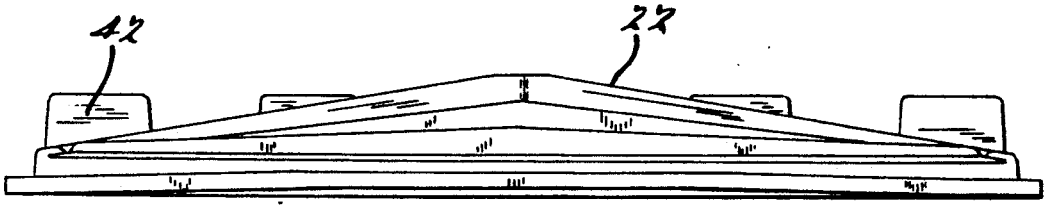
FIG. 6 is the front view of the cover shown in FIG. 2.
Figure 7:
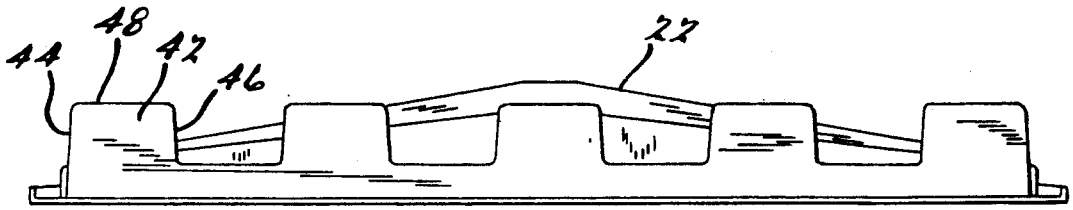
FIG. 7 is the rear view of the cover shown in FIG. 2.
Figure 4:
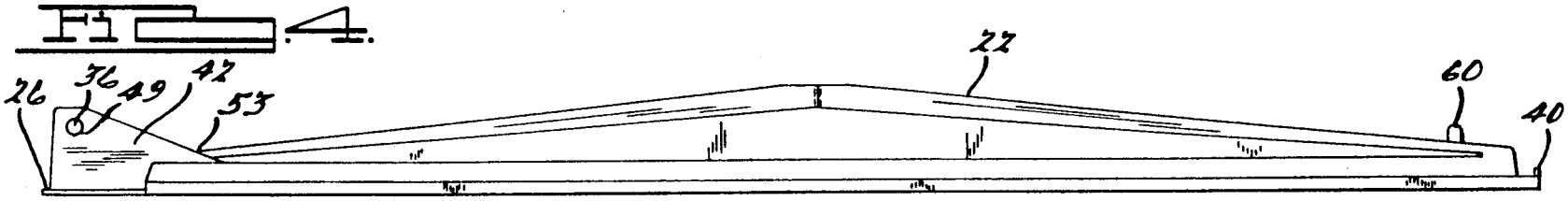
FIG. 4 shows the left side of the cover shown in FIG. 2.
Figure 5:
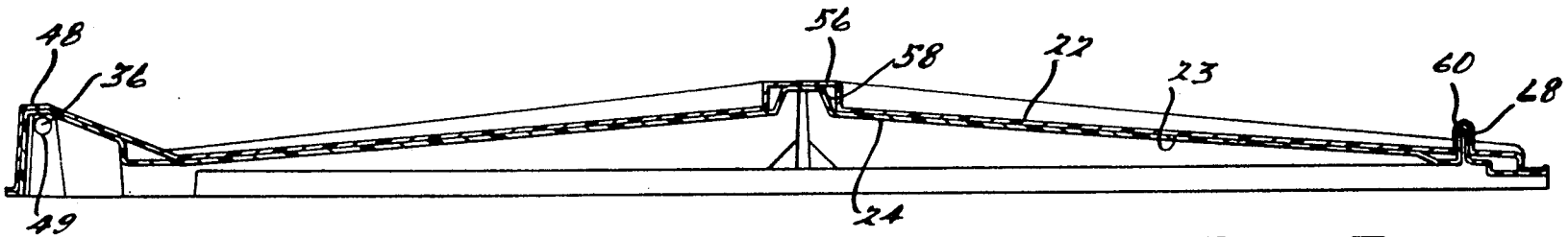
FIG. 5 is a longitudinal section view of the cover taken along line 5—5 of FIG. 2.

Turning now to the drawings, FIG. 1 shows a generally rectangular, upwardly open, trash receiving receptacle 10 covered by a pair of generally rectangular plastic covers 12. The receptacle includes four side walls 14, 16, 18 and 20 which extend vertically upwardly from a base to terminate, respectively, in coplanar top edges 13, 15, 17 and 19. The left and right side walls 16 and 20 typically include a channel (not shown) for receiving lifting bars from a loading truck. Each cover 12 is hinged to the top of the receptacle near the rear wall 18 and is moved between a closed position engaged with front wall 14 of the receptacle, as shown by the lid to the right, and an open position elevated relative to the top of the receptacle, as shown by the lid to the left. Because each cover 12 is identical, only one will be described herein.

Referring to FIGS. 2-9, in accordance with this invention cover 12 is formed of two rectangular sheets of a suitable thermoplastic material including an upper sheet which forms a top section 22 and a lower sheet which forms a bottom section 24. When formed, cover 12 includes a rear edge 26, a front edge 28, a left edge 30, a right edge 32, and a hinge arrangement 34 along its rear edge 26 to receive a pin 36 whereby to support the cover to the receptacle. The front edge 28 of the cover is somewhat arcuate (i.e., bowed upwardly) as it extends between the left and right edges 30 and 32 such that the medial portion of front edge 28 is not in contact with the front edge 13 of the receptacle. Advantageously, when exposed to the sun or when in certain hot climates, heat will cause the cover to relax and the front edge thereof to come into contact with the receptacle.

The outer peripheries of each sheet of the upper and lower sections 22 and 24 are welded together to define a closed interior cavity 38 and a U-shaped flange 40 to stiffen the outer shape of the cover and thereby enhance resistancy to twist. Flange 40 extends continuously along the left and right edges 30 and 32 and front edge 28 to define a drain channel to assist in water drainage from the cover. When the user lifts the cover, water will drain outwardly through an opening 41 adjacent hinge arrangement 34. To prevent inflation of the cover in very hot weather several vent holes (not shown) may be provided in the lower surface thereof.

A plurality of U-shaped hinge support housings 42 are provided adjacent rear edge 26, the housings being laterally spaced between left and right edges 30 and 32. Each housing includes a pair of laterally spaced vertical support walls 44 and 46, a top wall 48 whereby to form a respective cavity 50. A series of apertures 49 pass through the vertical support walls 44 and 46 of each support housing to provide means for receiving the hinge pin. When the cover is formed, like shaped support housing portions are formed both in the upper sheet and in the lower sheet with the housing portions on the upper sheet being provided with a cavity sized to receive a respective support housing portion from the lower sheet, whereupon the respective walls of the interfitted support housings are welded together to form a double wall thickness, through which apertures 49 are formed.

Top section 22 of the cover is generally pyramidal in shape and includes a pair of linearly extending rib members 52 and 54 that project upwardly from the plane of the upper sheet and divide the sheet into four triangular-shaped wall segments. The segments taper inwardly and upwardly from adjacent the edges 26, 28, 30 and 32 and towards the geometric center of the upper sheet whereat section 22 has a maximum vertical rise. Ribs 52 and 54 are generally U-shaped in cross-section and each has one end portion 53 thereof integrally formed with a hinge support housing 42 adjacent to one of the rear corners of the top section and its other end portion 55 terminating at a location proximate to one of the front corners.

Preferably and in accordance with this invention ribs 52 and 54 taper generally upwardly from the plane of the sheet and intersect with one another at the center of the sheet to define a generally rectangular-shaped receptacle 56 for receiving a like-shaped post 58 from the lower section. Post 58 is configured to nest within the receptacle, engage the walls of ribs 52 and 54, and be welded to the walls of ribs 52 and 54 where they meet the post.

A linear stiffening rib 60 extends laterally between the longitudinally extending left and right edges 30 and 32 and projects upwardly from upper section 22 to form a reinforcement rib to further inhibit twisting of the forward end of the cover. Rib 60 tapers upwardly from its ends 62 and forms a central peak 64. Ends 62 are curved and nest within a cutout or recess 65 defined at the respective ends of ribs 52 and 54 and function to increase rigidity of the cover.

Bottom section 24 includes a deformation reinforced central section for directly covering the open top of the receptacle. The sheet of this section is formed to include a plurality of parallel linear stiffening ribs 66 extending longitudinally as a continuation from a respective hinge support housing cavity 50 adjacent rear edge 26 and towards front edge 28. A linear stiffening rib 68 extends laterally between side edges 30 and 32 this rib being disposed adjacent to the front edge and superimposed by stiffening rib 60 on upper section 22. Rib 68 interlocks with the curved end portions 62 of linear rib 60 to lock the sheets together.

Each of the stiffening ribs 66 extend into the interior cavity 38 of the cover and each has its upward end welded to the interior surface 23 of top section 22 and selectively intersecting the ribs 52, 54 and 60 of the upper sheet. The upper sheet is generally parallel to and spaced from the lower sheet with the rib weldings providing a box-structure that inhibits flexure, twisting, buckling, or warping.

The ribs 66 and 68 on bottom section 24 are arrayed on axes orthogonal (i.e., perpendicular) to the edges 26 and 28, and 30 and 32. The linear ribs 52 and 54 are arranged to be oblique with respect to each other and to the axes of ribs 66 and 68.

Figure 8:
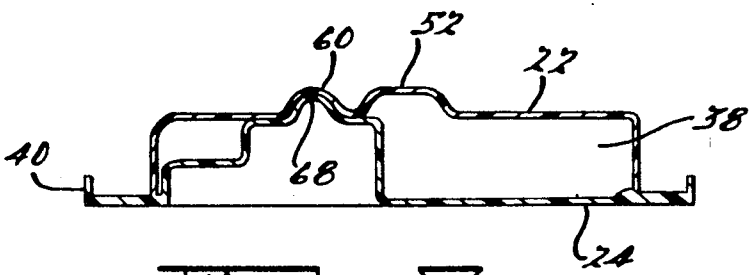
FIG. 8 is a section view near the front corner of the cover taken along line 8—8 of FIG. 2.

FIG. 8 is a detailed section view taken adjacent the left front corner showing the interior of the cover and the interlocked relation and box-beam construction formed between rib 6 extending upwardly from the bottom section and rib 60 formed in the top section. Curved end portions 62 are more clearly shown as they interlock with rib 68.

Figure 9:
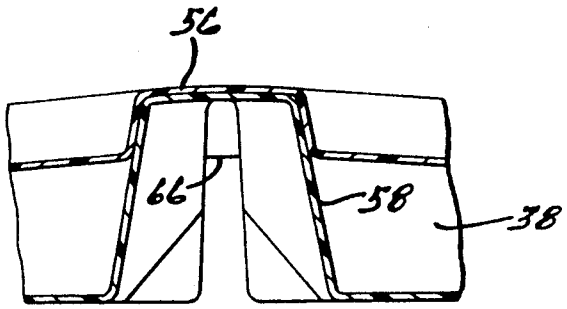
FIG. 9 is a lateral section view of the cover taken along line 9—9 of FIG. 2.

FIG. 9 shows the interior of the cover 12 and at the center of the upper and lower sections 22 and 24 to show the enclosed interior cavity 38, and the upward extensions of stiffening ribs 66 from the bottom section being welded to the top section 22. The intersecting, U-shaped stiffening ribs 52 and 54 that are integrally formed with and extend perpendicularly upward from the upper section 22 are shown defining the receptacle 56 to receive and be fusion welded to the post 58 from bottom section.

A method of making the cover for use with a receptacle comprises the steps of assembling a pair of planar sheets each substantially rectangular in shape. The sheets are then vacuum thermoformed to include the plurality of ribs 52, 54 and 60 and hinge support housings extending from the upper sheet, and the plurality of ribs 66 and 68 and hinge support housings extending from the lower sheet. The first and second sheets are brought into facing relation with one another and, while still hot, pressed together, whereby the edges of the two sheets are welded together to form the sealed interior 38 and peripheral flange 40, and the ribs from the bottom section are welded to the inner surface of the upper sheet and partially to the ribs of the upper section. This overall process is often referred to as twin sheet thermoforming.

The welding step results in the periphery of the sheets and the hinge housing portions being welded together to form a double wall thickness to retain shape and cover rigidity. Selective of the first and second ribs to reinforce the central section engage one another. Ribs 52 and 54, forming the central receptacle 56 on the upper sheet, receives the male member 58 from the lower sheet and the post is welded therewithin to lock the central portion of the sheets.

Preferably the top and bottom sections of the cover are vacuum formed of a suitable sheet plastic such as high density polyethylene (i.e., HDPE), or a high molecular weight HDPE. One suitable plastic is supplied by Allied Chemical Corporation under its name BA-50100. Generally, for the purposes intended herein, a sheet can be between 0.060 inches to 0.150 inches in thickness. In one embodiment it was found that a lid of 58 inches by 36 inches needed a wall no thicker than 0.090 inches. The term "welded" is meant to encompass fused or the like where the plastic parts are melted together.

While the above description constitutes the preferred embodiment of the invention, it will be appreciated that the invention is susceptible to modification, variation, and change without departing from the proper scope or fair meaning of the accompanying claims.

What is claimed is:

1. A cover for use with a receptacle having an open top, said cover comprising a substantially planar body formed from upper and lower sheets of flexible polymer material and having a deformation reinforced central section sized to extend across the open top of the receptacle, said central section comprising a plurality of parallel linearly extending first stiffening ribs extending from one said sheet and welded to the other said sheet, and a pair of linearly extending second stiffening ribs extending from said other sheet, said second ribs intersecting one another and said first ribs.

2. The cover as recited in claim 1 wherein said cover has an outer periphery of generally rectangular shape and includes a peripheral side flange to stiffen the outer periphery of the cover, hinge means for securing the cover to the receptacle for movement between an open position elevated relative to the top of the receptacle and a closed position engaged with the receptacle and each said rib is spaced inwardly from the outer periphery.

3. The cover as recited in claim 1 wherein said cover is generally rectangular having a front and rear edge extending laterally and a left and right edge extending longitudinally, and wherein said second stiffening ribs are generally orthogonal to one another and disposed on axes which are oblique to the edges of the cover.

4. The cover as recited in claim 3 wherein said upper and lower sheets have their outer peripheral portions welded together whereby to define a substantially sealed interior, and includes hinge means for securing the cover to the receptacle, the hinge means including at least a pair of laterally spaced hinge support housings extending along the rear edge of the cover.

5. The cover as recited in claim 4 wherein said cover forms an arcuate surface between the left and right edges, and further includes a flange extending upwardly from the edges thereof to form a channel whereby to assist in water drainage and stiffen the periphery of the cover.

6. The cover as recited in claim 2 wherein said hinge means comprises at least a pair of laterally spaced hinge support housings for supporting a hinge pin forming part of the hinge means, said support housings being formed by a portion of the lower sheet being welded into a portion of the upper sheet, each of said support housings including an opening for passing the hinge pin.

7. The cover as recited in claim 1 wherein said upper sheet is pyramidal in form and angles downwardly from the center of the upper sheet to the edges whereby to assist in water drainage.

8. A cover for use with a receptacle having an open top and its edges disposed in generally coplanar relationship, said cover comprising a substantially planar body formed from upper and lower sheets of flexible lighweight polymeric material and having a reinforced central section, said reinforced central section comprising a plurality of parallel straight first stiffening ribs projecting from one of said sheets and a pair of straight second stiffening ribs projecting from the other of said sheets, said second stiffening ribs being disposed along respective lines that are oblique to said first stiffening ribs and intersecting one another and said first stiffening ribs, the upward extensions of one said first and second stiffening ribs being welded to the opposite sheet.

9. The cover as recited in claim 8 wherein the upper and lower sheets of said body are generally rectangular and have their corresponding left, right, front and rear edges secured together whereby to define an interior cavity which encloses said first ribs, and hinge means for securing the body to the receptacle.

10. The cover as recited in claim 9 wherein said hinge means comprises at least a pair of laterally spaced, U-shaped hinge support housings extending upwardly from the plane of said upper sheet, each said housing being comprised of a lower sheet portion being formed and welded into a like-shaped upper sheet portion.

11. The cover as recited in claim 10 wherein said housings define a pair of vertical support walls each having an aperture to pass an elongated hinge pin for mounting the cover to the receptacle.

12. The cover as recited in claim 8 wherein said second stiffening ribs are disposed along lines that are orthogonal to one another.

13. The cover as recited in claim 9 including stiffening means for stiffening the forward end portion of said cover, including a first linear rib member extending upwardly from said lower sheet being received in and welded into a like second linear rib member extending from said upper sheet, said first and second rib members extending in a direction transverse to said first stiffening ribs.

14. The cover as recited in claim 13 wherein said stiffening means includes said second rib member including curved ends which interlock with the respective ends of the first rib members.

15. A cover for use with a receptacle having an open top, said cover being formed of upper and lower sheets of plastic and comprising a deformation reinforced central section for covering said open top, said section characterized by a plurality of spaced apart parallel first stiffening ribs on said lower sheet and by a pair of second stiffening ribs on said upper sheet, said second ribs intersecting one another and extending on lines which are oblique to the first ribs, and said first ribs being welded to the upper sheet and at least in part to the second ribs.

16. The cover as recited in claim 15 wherein said central section is generally rectangular and includes a front, a rear, a left and a right edge, said first stiffening ribs extending along lines parallel to one another and the left and right edges and between said front and rear edges, and said second stiffening ribs extending diagonally between the opposite corners.

17. The cover as recited in claim 15 and characterized by a top and bottom section being joined together to form a closed interior enclosing said first stiffening ribs, and portions of each said section being welded together to form at least a pair of laterally spaced hinge support housing, the second stiffening ribs having one of their respective ends integrally formed with a respective hinge housing and extending generally diagonally across the upper section to form an X-shaped reinforcement structure which inhibits buckling and welded to the other of said top and bottom section.

18. A cover of generally rectangular shape having a deformation reinforced central section comprising top and bottom sections being joined together to form a closed interior, a pair of linear first stiffening ribs being formed in one of said sections and intersecting with one another at a location centrally of the cover to form an X-shaped reinforcement structure, a plurality of linear second stiffening ribs being formed in the other of said sections, said first stiffening ribs being disposed along axes that are oblique to one another and to said second stiffening ribs and stiffening means associated with said first stiffening ribs and one said second stiffening rib for welding the centers of the sections together.

19. The cover as recited in claim 18 wherein said stiffening means comprises a shaped receptacle being formed by said first ribs and a shaped post projecting from said bottom section, said post being welded into said receptacle.

* * * * *

UNITED STATES PATENT AND TRADEMARK OFFICE

CERTIFICATE OF CORRECTION

PATENT NO. : 5,088,616

DATED : February 18, 1992

INVENTOR(S) : Thomas J. Susko, James P. Constantino, Gerald A. Parylo

It is certified that error appears in the above-identified patent and that said Letters Patent is hereby corrected as shown below:

Column 4, line 32, "6" should be -- 68 --.

Signed and Sealed this

Eighth Day of June, 1993

*Attest:*

Michael K. Kirk

MICHAEL K. KIRK

*Attesting Officer*

*Acting Commissioner of Patents and Trademarks*